US007327356B2

(12) United States Patent
Yusa

(10) Patent No.: US 7,327,356 B2
(45) Date of Patent: Feb. 5, 2008

(54) DATA TRANSMISSION DEVICE AND DATA TRANSMISSION METHOD

(75) Inventor: Kazuyuki Yusa, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 583 days.

(21) Appl. No.: 11/004,936

(22) Filed: Dec. 7, 2004

(65) Prior Publication Data

US 2005/0125577 A1 Jun. 9, 2005

(30) Foreign Application Priority Data

Dec. 8, 2003 (JP) ..... 2003-409012

(51) Int. Cl.
*G09G 5/00* (2006.01)

(52) U.S. Cl. ..... 345/204; 345/98

(58) Field of Classification Search ..... 345/98, 345/99, 100, 204, 690, 692; 365/233; 375/257; 341/100

See application file for complete search history.

(56) References Cited

U.S. PATENT DOCUMENTS 6,765,599 B2 * 7/2004 Nagai et al. ..... 345/520
6,788,106 B2 * 9/2004 Kwak et al. ..... 326/52
6,940,496 B1 * 9/2005 Kim ..... 345/204
7,193,597 B2 * 3/2007 Sunohara ..... 345/98
2002/0005863 A1 * 1/2002 Nagai et al. ..... 345/698
2002/0040459 A1 * 4/2002 Watanabe et al. ..... 714/738
2003/0031082 A1 * 2/2003 Sawada ..... 365/233
2003/0038771 A1 * 2/2003 Sunohara ..... 345/103
2003/0043926 A1 * 3/2003 Terashima et al. ..... 375/257
2003/0048209 A1 * 3/2003 Buchanan et al. ..... 341/100

FOREIGN PATENT DOCUMENTS

CN 1347042 5/2002
JP 2001-144620 5/2001

* cited by examiner

*Primary Examiner*—Nitin I. Patel
(74) *Attorney, Agent, or Firm*—Young & Thompson

(57) ABSTRACT

The data transmission device transmits parallel data of a plurality of bits. The data transmission device includes a parallel data control unit that outputs parallel data for which the logic level of each bit of the parallel data is inverted when the number of bits representing a first logic level is greater than the number of bits representing a second logic level, a data transmitter portion that allows a second current that is larger than a first current representing the first logic level to flow to signal lines corresponding with a bit representing the second logic level; and a parallel data supply control unit that supplies parallel data for which the logic level of each bit of the parallel data is inverted to the reception side.

14 Claims, 8 Drawing Sheets

| NUMBER OF BITS REPRESENTING "H" | 8 | 7 | 6 | 5 | 4 | 3 | 2 | 1 | 0 |
|---|---|---|---|---|---|---|---|---|---|
| NUMBER OF BITS REPRESENTING "L" | 0 | 1 | 2 | 3 | 4 | 5 | 6 | 7 | 8 |
| COMPARATOR CIRCUIT OUTPUT | "H" | "H" | "H" | "H" | "H" | "L" | "L" | "L" | "L" |
| TOTAL CURRENT | 0 | i | 2i | 3i | 4i | 4i | 3i | 2i | i |

| NUMBER OF BITS REPRESENTING "H" | 8 | 7 | 6 | 5 | 4 | 3 | 2 | 1 | 0 |
|---|---|---|---|---|---|---|---|---|---|
| NUMBER OF BITS REPRESENTING "L" | 0 | 1 | 2 | 3 | 4 | 5 | 6 | 7 | 8 |
| TOTAL CURRENT | 0 | i | 2i | 3i | 4i | 5i | 6i | 7i | 8i |

DATA TRANSMISSION DEVICE AND DATA TRANSMISSION METHOD

BACKGROUND OF THE INVENTION

1. Field of the Invention

The present invention relates to a data transmission device and a data transmission method and, more particularly, to a data transmission device and a data transmission method that transmit parallel data.

2. Description of Related Art

Data transmission devices transmit parallel data from a transmission side to a reception side.

For example, in a liquid crystal display device (hereinafter as 'LCD module'), 6-bit or 8-bit parallel data is used as data for each of red (R), green (G) and blue (B) colors. The parallel data for each color is transmitted from a control LSI at the transmission side to a driver LSI at the reception side.

More specifically, the control LSI transmits data from a built-in transmitter (Tx) to parallel signal lines and the reception-side driver LSI receives data from the parallel signal lines by means of a built-in receiver (Rx). In the case of small size LCD modules, a controller LSI with a built-in transmitter (Tx) may not be mounted in the LCD module.

Japanese Unexamined Patent Application Publication No. 2001-144620 discloses a technology that, in a bus system that performs parallel data transmission via a plurality of signal lines, the occurrence of crosstalk noise on the plurality of signal lines is decreased by reducing the frequency of occurrence of "0" or "1" contained in the transmitted parallel data.

FIG. 6 is a circuit diagram showing part of the transmission side of the bus system that appears in Japanese Unexamined Patent Application Publication No. 2001-144620. Hereinbelow, with reference to FIG. 6, a bus system that appears in Japanese Unexamined Patent Application Publication No. 2001-144620 will be described briefly.

In the case of the bus system that appears in Japanese Unexamined Patent Application Publication No. 2001-144620, transmission-side EXOR gates 80 to 82 supply transmission parallel data D00 to D02 to a plurality of signal lines. The interface between the transmission side and the plurality of signal lines is thus a CMOS (voltage) method interface.

On the transmission side, AND gates 83 to 85 and a NOR gate 86 judge whether the number of data representing "0" in the parallel data scheduled for transmission is greater than the number of data representing "1". The EXOR gates 80 to 82 then control inversion of the parallel data scheduled for transmission on the basis of the judgment result outputted by the NOR gate 86 so that the frequency of occurrence of "0" or "1" in the parallel data is reduced.

Therefore, an output of the EXOR gates 80 to 82 reduces the frequency of occurrence of "0" or "1" and hence there is a lower probability of a change in the output of the EXOR gates 80 to 82. For this reason, the occurrence of crosstalk noise in the plurality of signal lines decreases.

In LCD modules that perform parallel data transmission, the volume of data transmitted has increased greatly due to the increased number of grayscales and higher resolution of the LCD modules. Therefore, in LCD modules that perform parallel data transmission, the number of transmission lines required for data transmission has increased, the transmission frequency has risen, and the total current flowing through the signal lines has increased.

The problem of the large total current flowing through the signal lines is not limited to LCD modules handling parallel data. It is common to electronic devices performing parallel data transmission.

Further, in the case of the bus system appearing in Japanese Unexamined Patent Application Publication No. 2001-144620, the probability of a change in the output of the EXOR gates 80 to 82 is reduced. Thus, a decrease in the switching current for changing the output of the EXOR gates 80 to 82 can be expected.

However, in the case of the bus system that appears in Japanese Unexamined Patent Application Publication No. 2001-144620, there is no specific mention of a reduction in the total current flowing through the signal lines.

It has now been discovered that, conventional data transmission device is unable to decrease total current flowing through the signal lines.

SUMMARY OF THE INVENTION

According to one aspect of the present invention, there is provided a data transmission device that transmits parallel data of a plurality of bits that is supplied from the transmission side in parallel to the reception side via a plurality of signal lines, wherein each of the plurality of bits represents a first logic level or a second logic level; the data transmission device includes a parallel data control unit that outputs the parallel data when the number of bits representing the first logic level in the parallel data is equal to or less than the number of bits representing the second logic level and outputs parallel data for which the logic level of each bit of the parallel data is inverted when the number of bits representing the first logic level is greater than the number of bits representing the second logic level, and outputs inversion information indicating whether the parallel data that is supplied from the transmission side is inverted; a plurality of signal lines corresponding with each bit of the parallel data outputted by the parallel data control unit; a data transmitter portion that allows a first current to flow to the signal lines corresponding with a bit representing the first logic level in the parallel data outputted by the parallel data control unit and allows a second current that is larger than the first current to flow to the signal lines corresponding with a bit representing the second logic level in the parallel data; a data receiver portion that outputs parallel data of a plurality of bits by outputting a bit representing the first logic level as an output that corresponds with a signal line in which the first current flows and outputting a bit representing the second logic level as an output that corresponds with a signal line in which the second current flows; and a parallel data supply control unit that, when the inversion information indicates that parallel data supplied from the transmission side is inverted, supplies parallel data for which the logic level of each bit of the parallel data outputted by the data receiver portion is inverted to the reception side, and that, when the inversion information indicates that the parallel data supplied from the transmission side is not inverted, supplies parallel data that is outputted by the data receiver portion to the reception side.

According to the above invention, a data transmitter portion allows a first current to flow to the signal lines corresponding with a bit representing the first logic level in the parallel data outputted by the parallel data control unit and allows a second current that is larger than the first current to flow to the signal lines corresponding with a bit representing the second logic level in the parallel data.

Therefore, the outputs of the parallel data control unit enables the frequency of occurrence of a bit representing the second logic level to be higher than the frequency of occurrence of a bit representing a first logic level and enables a reduction in the total current flowing through the signal lines.

According to the above invention, the total current flowing through the signal lines can be effectively reduced.

According to another aspect of the present invention, there is provided a data transmission method that is performed by a data transmission device that transmits parallel data of a plurality of bits that is supplied from the transmission side in parallel to the reception side via a plurality of signal lines, wherein each of the plurality of bits represents either a first logic level or a second logic level; the data transmission method includes controlling parallel data such that, when the number of bits representing the first logic level in the parallel data is equal to or less than the number of bits representing the second logic level, the parallel data are outputted and, when the number of bits representing the first logic level is greater than the number of bits representing the second logic level, parallel data for which the logic level of each bit of the parallel data is inverted are outputted, and such that inversion information indicating whether the parallel data that is supplied from the transmission side is inverted is outputted; transmitting data such that a first current flows to the signal lines corresponding with a bit representing the first logic level in the parallel data that are outputted in the control of the parallel data and a second current that is larger than the first current flows to the signal lines corresponding with a bit representing the second logic level in the parallel data; receiving data so that parallel data of a plurality of bits are outputted by outputting a bit representing the first logic level as an output that corresponds with a signal line in which the first current flows among the plurality of signal lines and outputting a bit representing the second logic level as an output that corresponds with a signal line in which the second current flows among the plurality of signal lines; and controlling the supply of parallel data such that, when the inversion information indicates that parallel data supplied from the transmission side is inverted, parallel data for which the logic level of each bit of the parallel data outputted in the data reception step is inverted is supplied to the reception side and, when the inversion information indicates that the parallel data supplied from the transmission side is not inverted, the parallel data that is outputted in the data reception step is supplied to the reception side.

According to the above invention, the total current flowing through the signal lines can be effectively reduced.

According to yet another aspect of the invention, there is provided a driver circuit formed on a single chip, comprising: a plurality of data terminals receiving parallel data; a plurality of transmitter circuits receiving the parallel data, each of the transmitter circuits controlling its output state in response to levels of the parallel data, one of the output state being corresponding to a current flowing state on an output line, the other one of the output state being corresponding to a high impedance state on the output line; and a data control unit receiving the parallel data and producing controlled data signals based on the parallel data, the controlled data signals being respectively applied to the transmitter circuits in order to reduce current flowing through the output lines when parallel data are supplied with the data terminals.

According to still another aspect of the invention, there is provided a data transmission device that transmits parallel data of a plurality of bits via a plurality of signal lines, wherein each of the plurality of bits representing a first logic level or a second logic level, the data transmission device comprising a parallel data control unit that outputs the parallel data when the number of bits representing the first logic level in the parallel data is equal to or less than the number of bits representing the second logic level and outputs parallel data for which the a logic level of each bit of the parallel data is inverted when the number of bits representing the first logic level is greater than the number of bits representing the second logic level, and outputs inversion information indicating whether the parallel data that is supplied from the a transmission side is inverted; and a data transmitter portion that allows a first current to flow to an output line corresponding with a bit representing the first logic level in the parallel data outputted by the parallel data control unit and allows a second current that is larger than the first current to flow to the output line corresponding with a bit representing the second logic level in the parallel data.

Therefore, the output of the parallel data control unit enables the frequency of occurrence of the bit representing the second logic level to be higher than the frequency of occurrence of the bit representing the first logic level, whereby the total current flowing through the signal lines can be reduced.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

First Embodiment

A first embodiment of the present invention will be described hereinbelow with reference to the drawings.

Figure 1:
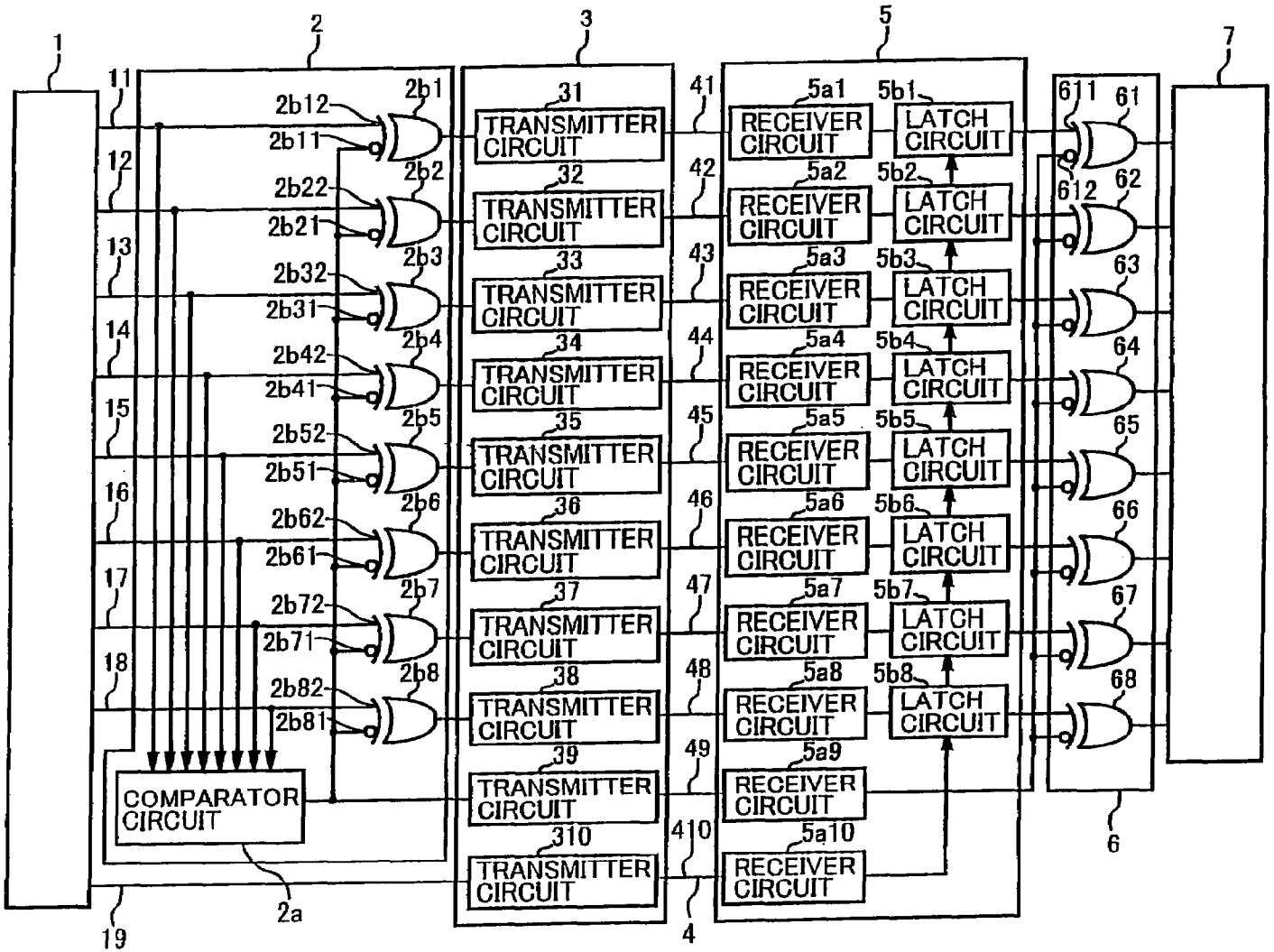
FIG. 1 is a block diagram showing a data transmission device of a first embodiment of the present invention.

FIG. 1 is a block diagram showing a data transmission device of an embodiment of the present invention.

In FIG. 1, the data transmission device of the present invention comprises a transmission-side LSI 1 constituting the transmission side, a parallel data control unit 2, a data transmitter portion 3, a plurality of signal lines 4*m* (more specifically, signal lines 41 to 49 and a signal line 410), a data receiver portion 5, a parallel data supply control unit 6 and a reception-side LSI 7 constituting the reception side.

The transmission-side LSI 1 outputs parallel data of a plurality of bits. In this embodiment, the transmission side LSI 1 uses 8-bit parallel data as parallel data of a plurality of bits. Further, the plural-bit parallel data is not limited to 8-bit parallel data and can be suitably varied as long as the parallel data has a plurality of bits. Further, the transmission-side LSI 1 may output liquid-crystal display device driving data, for example, as plural-bit parallel data. Therefore, an amount of electrical power consumed during parallel data transmission in the liquid crystal display device can be reduced.

The transmission-side LSI 1 outputs 8-bit parallel data by supplying 1-bit data simultaneously to each of signal lines in (more specifically, the signal lines 11 to 18). Further, each of the plurality of bits represents either of a first logic level (referred to as "L" hereinbelow) and a second logic level (referred to as "H" hereinbelow) that is different from "L".

The transmission side LSI 1 also outputs, to a signal line 19, a clock signal that regulates the timing at which the 8-bit parallel data is read.

The parallel data control unit 2 outputs the parallel data that is supplied by the transmission-side LSI 1 when the number of bits representing "L" in the parallel data supplied by the transmission-side LSI 1 is equal to or less than the number of bits representing "H".

Further, the parallel data control unit 2 outputs the parallel data for which the logic level of each bit of the parallel data that is supplied by the transmission-side LSI 1 is inverted when the number of bits representing "L" in the parallel data supplied by the transmission-side LSI 1 is more than the number of bits representing "H".

The parallel data control unit 2 also outputs inversion information indicating whether the logic level of each bit of the parallel data that is outputted by the transmission-side LSI 1 is inverted.

More specifically, the parallel data control unit 2 comprises a comparator circuit 2*a* and a plurality of EX-OR gates 2*bn* (specifically, the EX-OR gates 2*b*1 to 2*b*8).

The comparator circuit 2*a* outputs "H" in cases where the number of bits representing "L" in the parallel data that is outputted by the transmission-side LSI 1 is equal to or less than the number of bits represent in FNOTg "H" and outputs "L" when the number of bits representing "L" is more than the number of bits representing "H". The output of the comparator circuit 2*a* is supplied to inversion input terminals 2*b*11 to 2*b*81 of the EX-OR gates 2*b*1 to 2*b*8.

Each of the EX-OR gates 2*bn* is connected to a signal line 1*n*. More specifically, the input terminal 2*b*12 of the EX-OR gate 2*b*1 is connected to the signal line 11. Further, the input terminal 2*b*22 of the EX-OR gate 2*b*2 is connected to the signal line 12, the input terminal 2*b*32 of the EX-OR gate 2*b*3 is connected to the signal line 13, the input terminal 2*b*42 of the EX-OR gate 2*b*4 is connected to the signal line 14, the input terminal 2*b*52 of the EX-OR gate 2*b*5 is connected to the signal line 15, the input terminal 2*b*62 of the EX-OR gate 2*b*6 is connected to the signal line 16, the input terminal 2*b*72 of the EX-OR gate 2*b*7 is connected to the signal line 17, and the input terminal 2*b*82 of the EX-OR gate 2*b*8 is connected to the signal line 18.

Therefore, the EX-OR gates 2*b*1 to 2*b*8 outputs the 8-bit parallel data outputted by the transmission-side LSI as is when the comparator circuit 2*a* outputs "H" and outputs the parallel data after inverting the logic level of each bit of the 8-bit parallel data outputted by the transmission-side LSI 1 when the comparator circuit 2*a* outputs "L".

The comparator circuit 2*a* outputs "L" when the number of bits representing "L" in the 8-bit parallel data outputted by the transmission-side LSI 1 is greater than the number of bits representing "H". The outputs from the EX-OR gates 2*b*1 to 2*b*8 are therefore such that the frequency of occurrence of "H" is higher than the frequency of occurrence of "L".

The data transmitter portion 3 comprises a plurality of transmitter circuits 3*m* (more specifically, the transmitter circuits 31 to 39 and the transmitter circuit 310). In this embodiment, the data transmitter portion 3 comprises transmitter circuits 31 to 38 for transmitting parallel data, a transmitter circuit 39 for transmitting inversion information that is the output of the comparator circuit 2*a*, and a transmitter circuit 310 for transmitting clock signal. Further, the clock signal that is supplied to the transmitter circuit 310 is represented by a combination of "H" and "L".

Each transmitter circuit 3*m* is constituted by an Nch OD (N-channel open-drain) transistor, for example.

The transmitter circuit 31 receives the output of the EX-OR gate 2*b*1, the transmitter circuit 32 receives the output of the EX-OR gate 2*b*2, the transmitter circuit 33 receives the output of the EX-OR gate 2*b*3, and the transmitter circuit 34 receives the output of the EX-OR gate 2*b*4, the transmitter circuit 35 receives the output of the EX-OR gate 2*b*5, the transmitter circuit 36 receives the output of the EX-OR gate 2*b*6, the transmitter circuit 37 receives the output of the EX-OR gate 2*b*7, and the transmitter circuit 38 receives the output of the EX-OR gate 2*b*8.

Further, the respective transmitter circuits 3*m* are connected to the signal lines 4*m*. More specifically, the transmitter circuit 31 is connected to the signal line 41, the transmitter circuit 32 is connected to the signal line 42, the transmitter circuit 33 is connected to the signal line 43, the transmitter circuit 34 is connected to the signal line 44, the transmitter circuit 35 is connected to the signal line 45, the transmitter circuit 36 is connected to the signal line 46, the transmitter circuit 37 is connected to the signal line 47, the transmitter circuit 38 is connected to the signal line 48, the transmitter circuit 39 is connected to the signal line 49, and the transmitter circuit 310 is connected to the signal line 410.

When each transmitter circuit 3*m* receives "L", a current of a predetermined intensity (first current) flows to the signal line 4*m* to which the particular transmitter circuit is connected, and when each transmitter circuit 3*m* receives "H", a current (second current) that is smaller than the current of the predetermined intensity (first current) flows to the signal line 4*m* to which the particular transmitter circuit is connected.

In this embodiment, the outputs from the EX-OR gates 2*b*1 to 2*b*8 are such that the frequency of occurrence of "H" is higher than the frequency of occurrence of "L", and therefore the total current flowing to the plurality of signal lines 4*m* can be reduced.

The data receiver portion 5 outputs plural-bit parallel data by outputting a bit representing "L" as an output that corresponds with the signal line in which the first current flows and outputting a bit representing "H" as an output that corresponds with the signal line in which the second current flows.

The data receiver portion 5 comprises receiver circuits 5*am* (more specifically, the receiver circuits 5*a*1 to 5*a*10) in the same quantity as the plurality of signal lines 4*m* and latch circuits 5*bn* (more specifically, the latch circuits 5*b*1 to 5*b*8) in the same quantity as the plurality of EX-OR gates 2*bn*.

The respective receiver circuits 5*am* are connected to signal lines 4*m*. More specifically, the receiver circuit 5*a*1 is connected to the signal line 41, the receiver circuit 5*a*2 is connected to the signal line 42, the receiver circuit 5*a*3 is connected to the signal line 43, the receiver circuit 5*a*4 is connected to the signal line 44, the receiver circuit 5*a*5 is connected to the signal line 45, the receiver circuit 5*a*6 is connected to the signal line 46, the receiver circuit 5*a*7 is connected to the signal line 47, the receiver circuit 5*a*8 is connected to the signal line 48, the receiver circuit 5*a*9 is connected to the signal line 49 and the receiver circuit 5*a*10 is connected to the signal line 410.

Each receiver circuit 5*am* outputs "L" when the current of the predetermined intensity (first current) flows to the signal line 4*m* to which the particular receiver circuit is connected and outputs "H" when the current (second current) that is smaller than the current of a predetermined intensity flows to the signal line 4*m* to which the particular receiver circuit is connected.

The respective latch circuits 5*bn* are connected to any of the receiver circuits 5*a*1 to 5*a*8. More specifically, the latch circuit 5*b*1 receives the output of the receiver circuit 5*a*1. Further, the latch circuit 5*b*2 receives the output of the receiver circuit 5*a*2, the latch circuit 5*b*3 receives the output of the receiver circuit 5*a*3, the latch circuit 5*b*4 receives the output of the receiver circuit 5*a*4, the latch circuit 5*b*5 receives the output of the receiver circuit 5*a*5, the latch circuit 5*b*6 receives the output of the receiver circuit 5*a*6, the latch circuit 5*b*7 receives the output of the receiver circuit 5*a*7, and the latch circuit 5*b*8 receives the output of the receiver circuit 5*a*8.

Each latch circuit 5*bn* latches the output of the transmitter circuit 5*am* that the particular latch circuit receives by using the output of the receiver circuit 5*a*10, more specifically, the clock signal of the transmission-side LSI 1. As a result, data that is latched by the latch circuits 5*b*1 to 5*b*8 represent parallel data constituting the output of the EX-OR gates 2*b*1 to 2*b*8.

When inversion information received by the receiver circuit 5*a*9 indicates the inversion of the parallel data supplied by the transmission-side LSI 1, the parallel-data supply control unit 6 supplies the parallel data for which the logic level of each bit of parallel data outputted by the data receiver portion 5 is inverted to the receiver side LSI 7 and, when the inversion information indicates that the parallel data supplied by the transmission-side LSI 1 is not inverted, the parallel-data supply control unit 6 supplies the parallel data outputted by the data receiver portion 5 to the reception-side LSI 7.

The parallel data supply control unit 6 comprises EX-OR gates 6*n* (specifically, the EX-OR gates 61 to 68) in the same quantity as the plurality of latch circuits 5*bn*.

Each of the EX-OR gates 6*n* is connected to the latch circuit 5*bn*. More specifically, the noninverting input terminal 611 of the EX-OR gate 61 receives the output of the latch circuit 5*b*1. Further, the noninverting input terminal of the EX-OR gate 62 receives the output of the latch circuit 5*b*2, the noninverting input terminal of the EX-OR gate 63 receives the output of the latch circuit 5*b*3, the noninverting input terminal of the EX-OR gate 64 receives the output of the latch circuit 5*b*4, the noninverting input terminal of the EX-OR gate 65 receives the output of the latch circuit 5*b*5, the noninverting input terminal of the EX-OR gate 66 receives the output of the latch circuit 5*b*6, the noninverting input terminal of the EX-OR gate 67 receives the output of the latch circuit 5*b*7, and the noninverting input terminal of the EX-OR gate 68 receives the output of the latch circuit 5*b*8.

The output of the receiver circuit 5*a*9, specifically, the output of the comparator circuit 2*a*, is supplied to the noninverting input terminal 612 of the EX-OR gate 61. The output of the receiver circuit 5*a*9 is supplied to the noninverting input terminal of the each EX-OR gate 6*n*. Therefore, the data that is outputted in parallel from the EX-OR gates 61 to 68 is 8-bit parallel data that is outputted by the transmission-side LSI 1.

The reception-side LSI 7 receives 8-bit parallel data that are outputted in parallel from the EX-OR gates 61 to 68.

Figure 2:
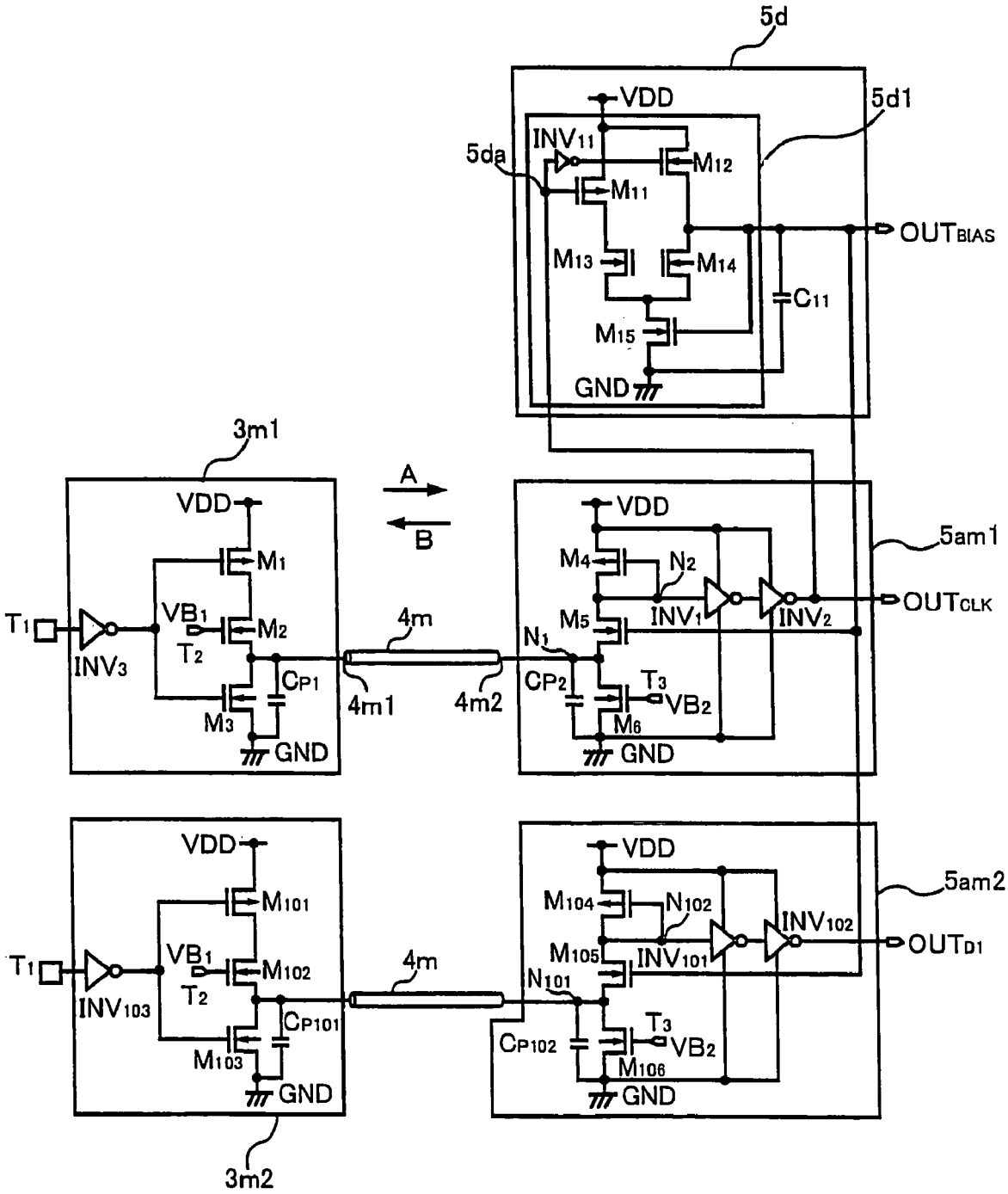
FIG. 2 is a circuit diagram showing an example of transmitter circuits and receiver circuits.

FIG. 2 is a circuit diagram showing an embodiment about transmitter circuits 3*m*, signal lines 4*m* and receiver circuits 5*am*.

The transmitter circuit 3*m*1 is the transmitter circuit. 310 that receives a clock signal from the signal line 19 and the transmitter circuit 3*m*2 is one of the transmitter circuits 31 to 38 that receives the output of the parallel data control unit 2. In actuality, there is a plurality of the transmitter circuit 3*m*2 that receives the outputs of the parallel data control unit 2 but FIG. 2 shows only one of the transmitter circuit 3*m*2 that receives an output of the parallel data control unit 2 in order to simplify the description.

In FIG. 2, the transmitter circuit 3*m*1 comprises a p-channel MOS transistor M1, an n-channel MOS transistor M2, an n-channel MOS transistor M3, and an inversion buffer INV3. The p-channel MOS transistor M1 and the n-channel MOS transistor M3 constitute an inverter circuit.

An input of the inversion buffer INV3 is connected to an input terminal T1.

A source of the transistor M1 is connected to the supply voltage terminal VDD, an output of the inversion buffer INV 3 is supplied to a gate of the transistor M1, and a drain of the transistor M1 is connected to a source of the transistor M2. A gate of the transistor M2 is connected to a voltage amplitude limiting bias input terminal T2 and a drain of the transistor M2 is connected to a drain of the transistor M3 and one end 4*m*1 of the signal line 4*m*. The output of the inversion buffer INV 3 is supplied to a gate of the transistor M3 and a source of the transistor M3 is connected to the ground terminal GND. A capacitance Cp1 is an output parasitic capacitance of the transmitter circuit 3*m*1.

The transmitter circuit 3*m*2 comprises a p-channel MOS transistor M101, an n-channel MOS transistor M102, an n-channel MOS transistor M103, and an inversion buffer INV 103. The p-channel MOS transistor M101 and the n-channel MOS transistor M103 constitute an inverter circuit.

The transmitter circuit 3*m*2 has the same constitution as the transmitter circuit 3*m*1. That is, in the transmitter circuit 3*m*2, the transistor M1 of the transmitter circuit 3*m*1 is the transistor M101, the transistor M2 of the transmitter circuit 3*m*1 is the transistor M102, the transistor M3 of the transmitter circuit 3*m*1 is the transistor M103, and the inversion buffer INV 3 of the transmitter circuit 3*m*1 is the inversion buffer INV 103. A capacitance Cp 101 is an output parasitic capacitance of the transmitter circuit 3*m*2.

A receiver circuit 5*am*1 is connected to the transmitter circuit 3*m*1 via the signal line 4*m*, or the signal line 410. A receiver circuit 5*am*2 is connected to the transmitter circuit 3*m*2 via the signal line 4*m*, or one of the signal lines 41 to 48. The receiver circuits 5*am*1 and 5*am*2 are connected to a bias circuit 5*d*. Further, the bias circuit 5*d* is contained in the data receiver portion 5.

The receiver circuit 5*am*1 comprises a p-channel MOS transistor M4, an n-channel MOS transistor M5, an n-channel MOS transistor M6, an inversion buffer INV 1, and an inversion buffer INV 2.

A source of the transistor M4 is connected to the supply voltage terminal VDD and a gate of the transistor M4 and a drain of the transistor M4 are connected to an input terminal of the inversion buffer INV 1. A source of the transistor M5 is connected to an input terminal of the inversion buffer INV 1, a gate of the transistor M5 is connected to an output terminal of the bias circuit 5*d*, a drain of the transistor M5 is connected to a drain of the transistor M6 and the other end 4*m*2 of the signal line 4*m*. A gate of the transistor M6 is connected to a constant current source bias input terminal T3 and a source of the transistor M6 is connected to the ground terminal GND.

An output terminal of the inversion buffer INV 1 is connected to an input terminal of the inversion buffer INV 2. An output of the inversion buffer INV 2 is an output of the receiver circuit 5*am*1. Further, the output of the inversion buffer INV 2 is inputted to the bias circuit 5*d*. A capacitance CP2 is an input parasitic capacitance of the receiver circuit 5*am*1.

The receiver circuit 5*am*2 comprises a p-channel MOS transistor M104, an n-channel MOS transistor M105, an n-channel MOS transistor M106, an inversion buffer INV 101, and an inversion buffer INV 102.

The receiver circuit 5*am*2 has the same constitution as the receiver circuit 5*am*1. That is, in the receiver circuit 5*am*2, the transistor M4 of the receiver circuit 5*am*1 is the transistor M104, the transistor M5 of the receiver circuit 5*am*1 is the transistor M105, the transistor M6 of the receiver circuit 5*am*1 is the transistor M106, the inversion buffer INV 1 of the receiver circuit 5*am*1 is the inversion buffer INV 101, and the inversion buffer INV 2 of the receiver circuit 5*am*1 is the inversion buffer INV 102. The capacitance CP 102 is the input parasitic capacitance of the receiver circuit 5*a*2. Further, in the receiver circuit 5*a*2, the output of the inversion buffer INV 102 is not supplied to the bias circuit 5*d*.

The transmitter circuit 3*m*1 and transmitter circuit 3*m*2 are constituted with the same dimensions and the same layout. Further, the receiver circuit 5*am*1 and receiver circuit 5*am*2 are constituted with the same dimensions and the same layout.

A common voltage VB2 is supplied to the constant current source bias input terminal T3 of the receiver circuit 5*am*1 and to the constant current source bias input terminal T3 of the receiver circuit 5*am*2, and the transistor M6 and transistor M106 constitute a constant current circuit.

A common voltage VB1 is supplied to the voltage amplitude limiting bias input terminal T2 of the transmitter circuit 3*m*1 and to the voltage amplitude limiting bias input terminal T2 of the transmitter circuit 3*m*2. Hence, when a bit supplied to the input terminal T1 represents "H", the transmitter circuit 3*m*1 and transmitter circuit 3*m*2 are able to render the potential of one end 4*m*1 of the signal line 4*m* a lower potential than the supply voltage VDD. Further, when the bit supplied to the input terminal T1 represents "H", the intensity of the current flowing through the signal line 4*m* can be limited.

Further, in actuality, a voltage that is applied to the signal line 4*m* when "H" is supplied to the input terminal T1 is determined by the transmitter circuit 3*m* and receiver circuit 5*am* that are connected to the respective ends of the signal line 4*m*.

The transistor MS of the receiver circuit 5*am*1 and the transistor M105 of the receiver circuit 5*am*2 function as electronic switches. Potentials of the node N2 and node N102 can be established close to the supply voltage VDD or close to the GND terminal level in accordance with the switch operations of the transistors MS and M105 and the input of the input terminal T1 of the transmitter circuit 3*m*.

The transistors M4 and MS contained in the receiver circuit 5*am*1 and the transistors M104 and M105 contained in the receiver circuit 5*am*2 also function as resistors of several k ohms, for example, that is, as current limiting elements.

The inversion buffer INV 1 and the inversion buffer INV 101 principally perform waveform generation.

The bias circuit 5*d* comprises a differential input circuit 5*d*l and a condenser C11.

The differential input circuit 5*d*1 comprises a p-channel MOS transistor M11, a p-channel MOS transistor M12, an n-channel MOS transistor M13, an n-channel MOS transistor M14, an n-channel MOS transistor M15, and an inversion buffer INV 11.

A gate of the transistor M11 becomes one input terminal of the differential input circuit 5*d*1 and an input terminal of the inversion buffer INV 11 becomes the other input terminal of the differential input circuit 5*d*1. An output terminal of the inversion buffer INV 11 is connected to a gate of the transistor M12.

The output of the receiver circuit 5*am*1 is inputted to an input terminal 5*da* of the bias circuit 5*d*.

The condenser C11 accumulates electrical charge when the transistor M12 is ON and discharges the charge that has accumulated in the condenser C11 via the transistor M14 and transistor M15 when the transistor M11 is ON.

In this embodiment, in order to afford an output of the bias circuit 5*d* a duty=50%, the transistor M11 and the transistor M12 have the same dimensions and the same layout, and the transistors M13 and M14 have the same dimensions and the same layout. Further, the transistor M15 functions as an electronic switch and the receiver circuit 5*am*1 prevents self-oscillation at high frequencies.

The output of the bias circuit 5*d* is supplied to the gate of the transistor M5 of the receiver circuit 5*am*1 and to the gate of the transistor M105 of the receiver circuit 5*am*2.

Next, the operation of the circuit shown in FIG. 2 will be described.

First, when "H" is supplied to the input terminal T1 of the transmitter circuit 3*m*l, the condenser C11 of the bias circuit 5*d* accumulates electrical charge until the voltage reaches the supply voltage VDD.

Thereafter, when a 50%-duty clock signal is supplied to the input terminal T1 of the transmitter circuit 3*m*1, the voltage of the condenser C11 drops to a value that allows the receiver circuit 5*am*1 to output a 50%-duty signal.

The potential that is inputted to the inversion buffer INV 1 and inversion buffer INV 101 can be adjusted by supplying the output of the bias circuit 5*d* to the gate of the transistor M5 and the gate of the transistor M105. Therefore, when the potential of the other end 4*m*2 of the signal line 4*m* is inappropriate as the input level of the inversion-buffer INV 1 and the input level of the inversion buffer INV 101, the potential of the other end 4*m*2 of the signal line 4*m* can be adjusted to an appropriate level as the input level of the inversion buffer INV 1 and the input level of the inversion buffer INV 101. As a result, the output of the receiver circuit can be stabilized.

Next, the operation in a state where the output of the bias circuit 5*d* is stabilized will be described. Further, the operations of the transmitter circuit 3*m*1 and receiver circuit 5*am*1 are described hereinbelow but the operations of the transmitter circuit 3*m*2 and receiver circuit 5*am*2 are the same operations.

When "H" is supplied to the input terminal T1 of the transmitter circuit 3*m*1, the potential of one end 4*m*1 of the signal line 4*m* is a potential that drops from the supply voltage VDD by the voltage corresponding with the transistor M2. That is, the n-channel MOS transistor M2 functions as a resistance-adjusting MOS transistor. Therefore, the current flows in the signal line 4*m* in the direction of the arrow A. The current passing through the signal line 4*m* flows to the GND terminal via the transistor M6 constituting the constant current source.

Here, the input of the inversion buffer INVL is "H" and the output of the receiver circuit 5*am*1 is "H". Further, because the transistor M4 is OFF, the intensity of the current (second current) flowing through the signal line 4*m* is an intensity that is limited by the transistor M6 constituting the constant current source.

Meanwhile, when "L" is supplied to the input terminal T1 of the transmitter circuit 3*m*1, the potential of the one end 4*m*1 of the signal line 4*m* is a GND-level potential. For this reason, the input of the inversion buffer INV 1 is then "L". Therefore, the transistor M4 is then ON and a current (first current) flows in the signal line 4*m* in the direction of the arrow B. Here, the intensity of the current (first current) flowing through the signal line 4*m* is not limited by the transistor M6 constituting the constant current source.

Therefore, in the case of this embodiment, as the intensity of the current flowing through the transistor M6 constituting the constant current source is reduced, the intensity of the current (first current) flowing to the signal line 4*m* when "L" is supplied to the input terminal T1 of the transmitter circuit 3*m*1 grows larger than the intensity of the current (second current) flowing to the signal line 4*m* when "H" is supplied to the input terminal T1 of the transmitter circuit 3*m*1. For example, the intensity of the current (first current) flowing to the signal line 4*m* when "L" is supplied to the input terminal T1 of the transmitter circuit 3*m*1 is two or more times the intensity of the current (second current) that flows to the signal line 4*m* when "H" is supplied to the input terminal T1 of the transmitter circuit 3*m*1.

Figure 3:
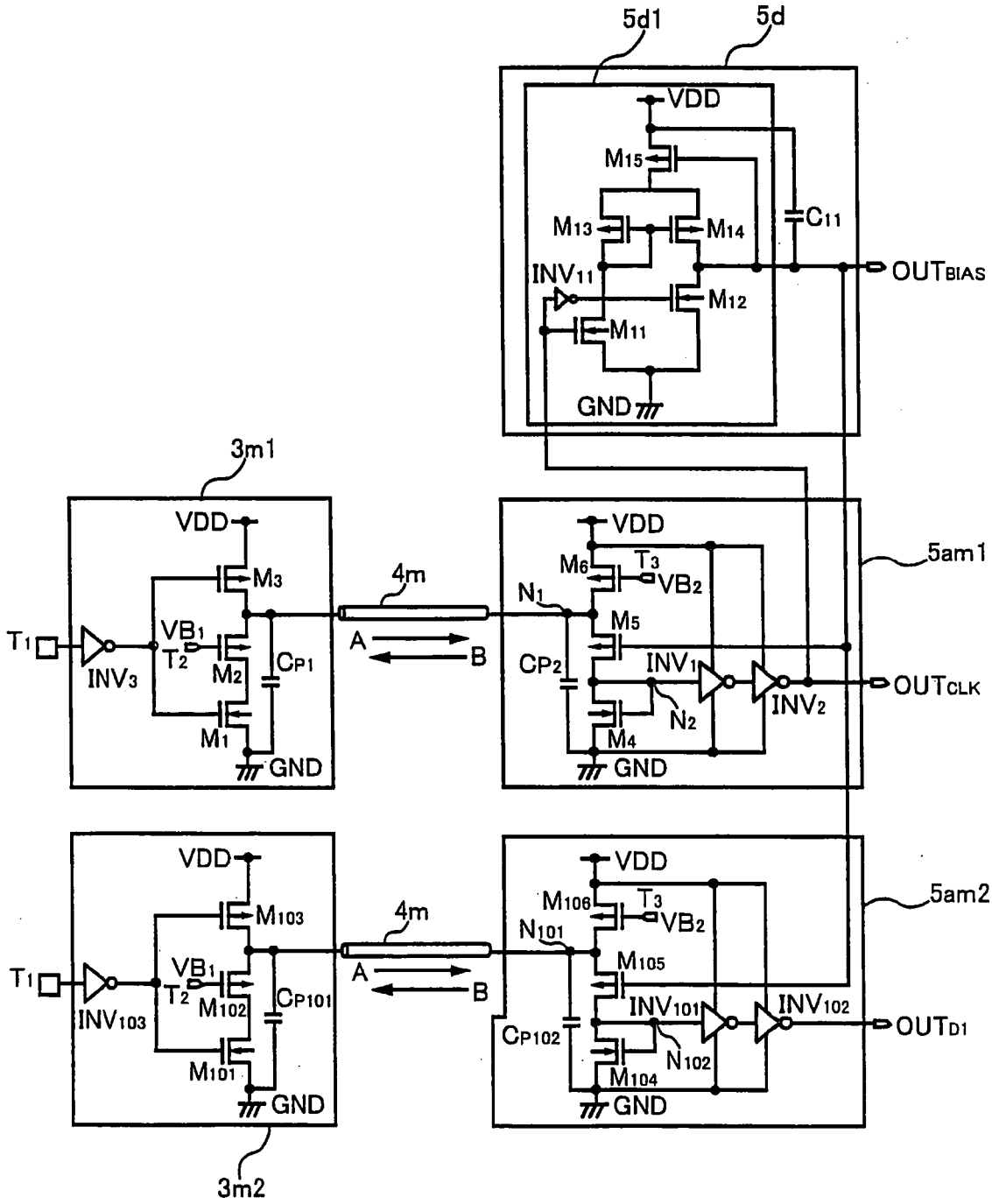
FIG. 3 is a circuit diagram showing another example of transmitter circuits and receiver circuits.

FIG. 3 is a circuit diagram showing another embodiment about transmitter circuits 3*m*, signal lines 4*m* and receiver circuits 5*am*. Further, in FIG. 3, the same reference symbols have been assigned to those parts that have the same constitution as parts shown in FIG. 2. Further, the operations of the transmitter circuit 3*m*1 and receiver circuit 5*am*1 are described hereinbelow, but the operations of the transmitter circuit 3*m*2 and receiver circuit 5*am*2 are also the same operations.

In the circuit shown in FIG. 3, when the input to the input terminal T1 is "H", the potential of one end of the signal line 4*m* is VDD and the transistor M4 is then ON. Therefore, a current (first current) of a predetermined intensity flows in the signal line 4*m* in the direction of the arrow A and the output of the receiver circuit 5*am* is then "H".

On the other hand, when the input to the input terminal T1 is "L", the potential of one end of the signal line 4*m* is a potential that exceeds GND level to an extent corresponding to the resistance of the transistor M2, and therefore the transistor M4 is then OFF. Therefore, the current (second current) whose the intensity is limited by the transistor M6 flows in the signal line 4*m* in the direction of the arrow B and the output of the receiver circuit 5*am* is then "L".

Further, because the operation of the circuit shown in FIG. 3 is basically the same as that of the constitution shown in FIG. 2, a detailed description of the former operation is omitted here.

If the constitution shown in FIG. 2 or FIG. 3 is adopted, the data transmission device can be a semiconductor device.

Figures 4, 5, 6:
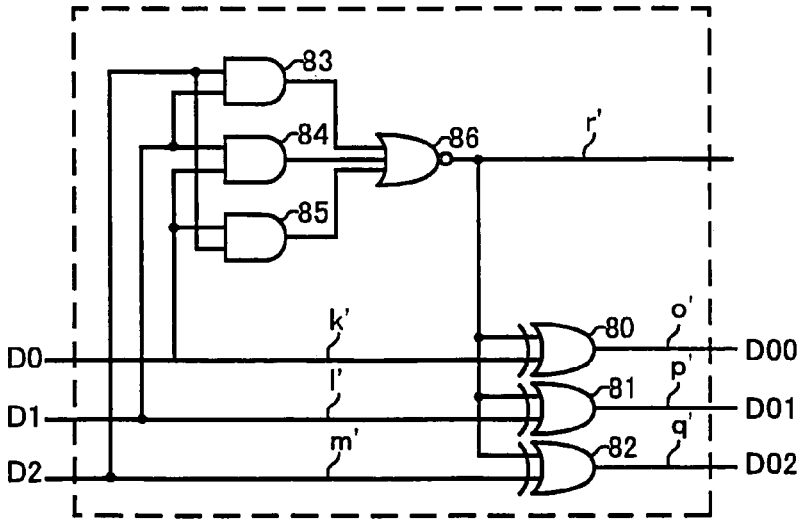
FIG. 4 is a table to explain the operation of the data transmission device shown in FIG. 1.
FIG. 5 is a table to explain a comparative example of the operation of a conventional data transmission device.
FIG. 6 is a circuit diagram showing part of the conventional data transmission device.

FIG. 4 is a table to explain the operation of the data transmission device shown in FIG. 1. The operation of the data transmission device will be described below with reference to FIG. 4.

As shown in FIG. 4, the comparator circuit 2*a* outputs "H" when the number of bits representing "H" in the 8-bit parallel data is equal to or more than four. Accordingly, the parallel data control unit 2 outputs the logic level of each bit of parallel data that is outputted by the transmission-side LSI 1 to the data transmitter portion 3 without changing the respective logic levels.

Here, when "L" is supplied to one transmitter circuit 3*m*, the intensity of the current (first current) flowing to a single signal wire is i. When the number of bits representing "H" in the 8-bit parallel data is four or more, the maximum value of the total current flowing through the signal lines 41 to 49 is 4*i*. That is, when the number of bits representing "H" is four and the number of bits representing "L" is four, the total current flowing through the signal lines 41 to 49 is then a maximum value 4*i*. Further, in this table, the transmitter circuit and receiver circuit are set such that, when an "H" bit is supplied to one transmitter circuit 3*m*, the intensity of the current flowing to a single signal line is substantially zero.

Further, the comparator circuit 2*a* outputs "L" when the number of bits representing "H" in the 8-bit parallel data is less than four. That is, when the number of bits representing "H" is three and the number of bits representing "L" is five, the total current flowing through the signal lines 41 to 49 is then a maximum value 4*i*. Accordingly, the parallel data control unit 2 outputs parallel data for which the logic level of each bit of the parallel data outputted by the transmission-side LSI 1 is inverted to the data transmitter portion 3.

Therefore, when the number of bits representing "H" in the 8-bit parallel data is less than four, the maximum value of the total current flowing through the signal lines 41 to 49 is then 4*i*.

FIG. 5 is a table to explain the values of the total current flowing through the signal lines in a case where parallel data supplied by the transmission-side LSI in a conventional data transmission device is outputted to the transmitter circuit as is.

As shown in FIG. 5, when parallel data supplied by the transmission-side LSI 1 is outputted to the transmitter circuit 3 as is, the maximum value of the total current flowing through the signal lines 41 to 49 is then 8*i*.

According to this embodiment, the data transmitter portion 3 allows the first current to flow to a signal line corresponding with a bit representing a first logic level in the parallel data outputted by the parallel data control unit 2 and allows a second current of a smaller intensity than the first current to flow to a signal line corresponding with a bit representing a second logic level in the parallel data.

The parallel data control unit 2 outputs the parallel data when the number of bits in the parallel data that represent the first logic level is equal to or less than the number of bits representing the second logic level and outputs parallel data for which the logic level of each bit of the parallel data is inverted when the number of bits representing the first logic level is greater than the number of bits representing the second logic level. For this reason, the output of the parallel data control unit 2 is such that the frequency of occurrence of a bit representing the second logic level is higher than the frequency of occurrence of a bit that represents the first logic level, whereby the total current flowing through the signal lines can be reduced.

Further, if the intensity of the first current is rendered two or more times the intensity of the second current, the total current flowing through the signal lines can be effectively reduced.

Further, if the transmission side supplies liquid crystal display device driving data as plural-bit parallel data, the electrical power consumed during parallel data transmission can be reduced in the liquid-crystal-display device.

This embodiment is an extremely effective signal transmission method for mobile applications in which the transmission frequency is not particularly high but where a consumption current reduction is important.

Moreover, this embodiment makes it possible to implement lower electrical power consumption and is therefore advantageous not only for data transmission devices but also in reducing the power consumed by electronic devices including the data transmission device of this embodiment or in driving for long periods battery driver devices that include the data transmission device of this embodiment.

Second Embodiment

Figure 7:
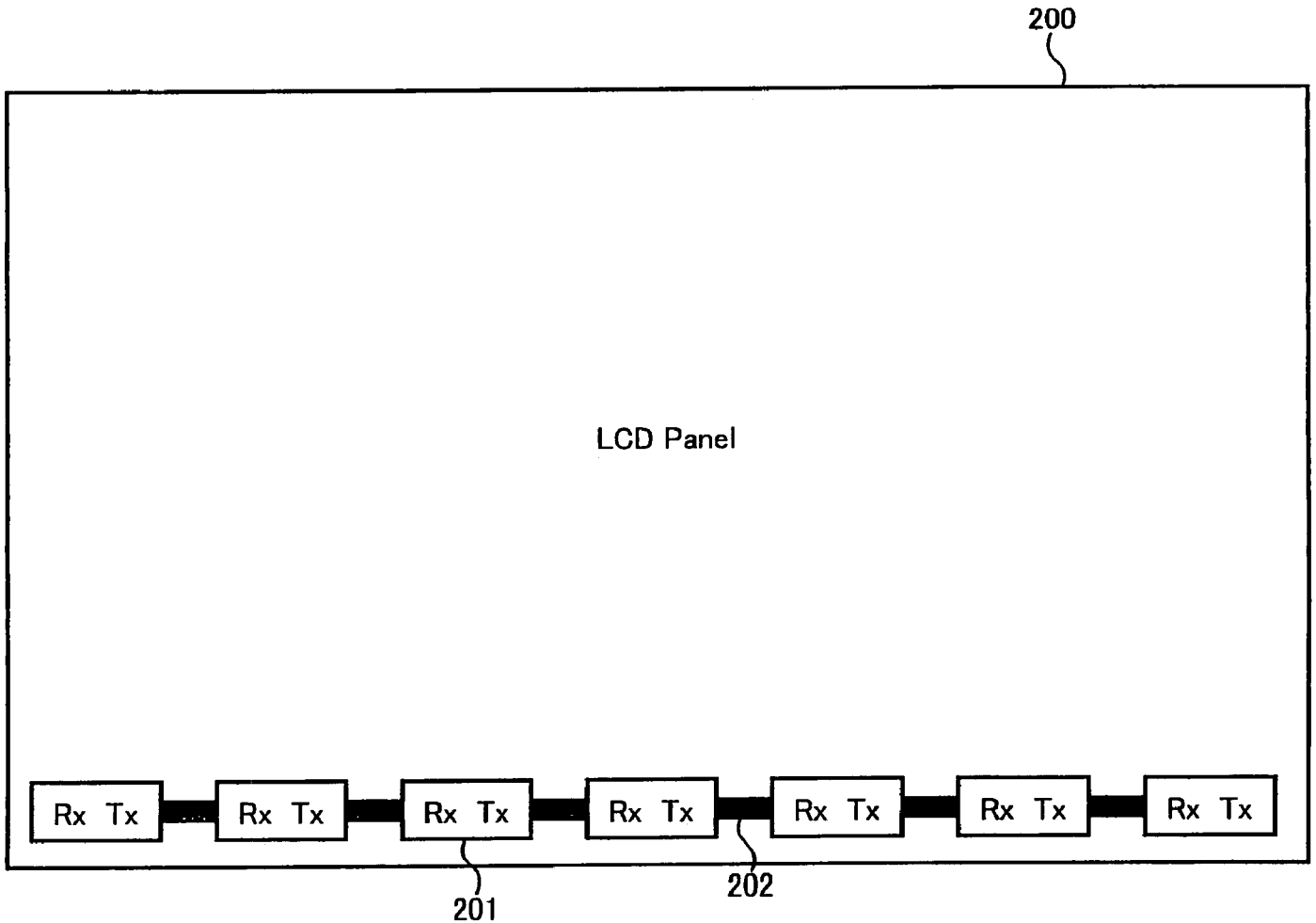
FIG. 7 is a diagram showing the structure of a LCD panel using a data transmission device of a second embodiment of the invention.

A data transmission device of a second embodiment is explained hereinbelow. This data transmission device is used for a driver IC of a LCD panel. As shown in FIG. 7, a plurality of driver ICs 201 are mounted on a LCD panel 200. A transmission line 202 is formed on the LCD panel 200, where the plurality of driver ICs 202 are connected in cascade. Each of the driver ICs 201 includes a transmitter portion and a receiver portion of the data transmission device of this invention. Data is transmitted and received between adjacent driver ICs 201. Specifically, the data transmitted from a transmitter portion of one driver IC 201 is received by a receiver portion of an adjacent driver IC 201. In this way, data is sequentially transmitted through the transmission line 202 from an upstream driver IC 201 to a downstream driver IC 201.

Figure 8:
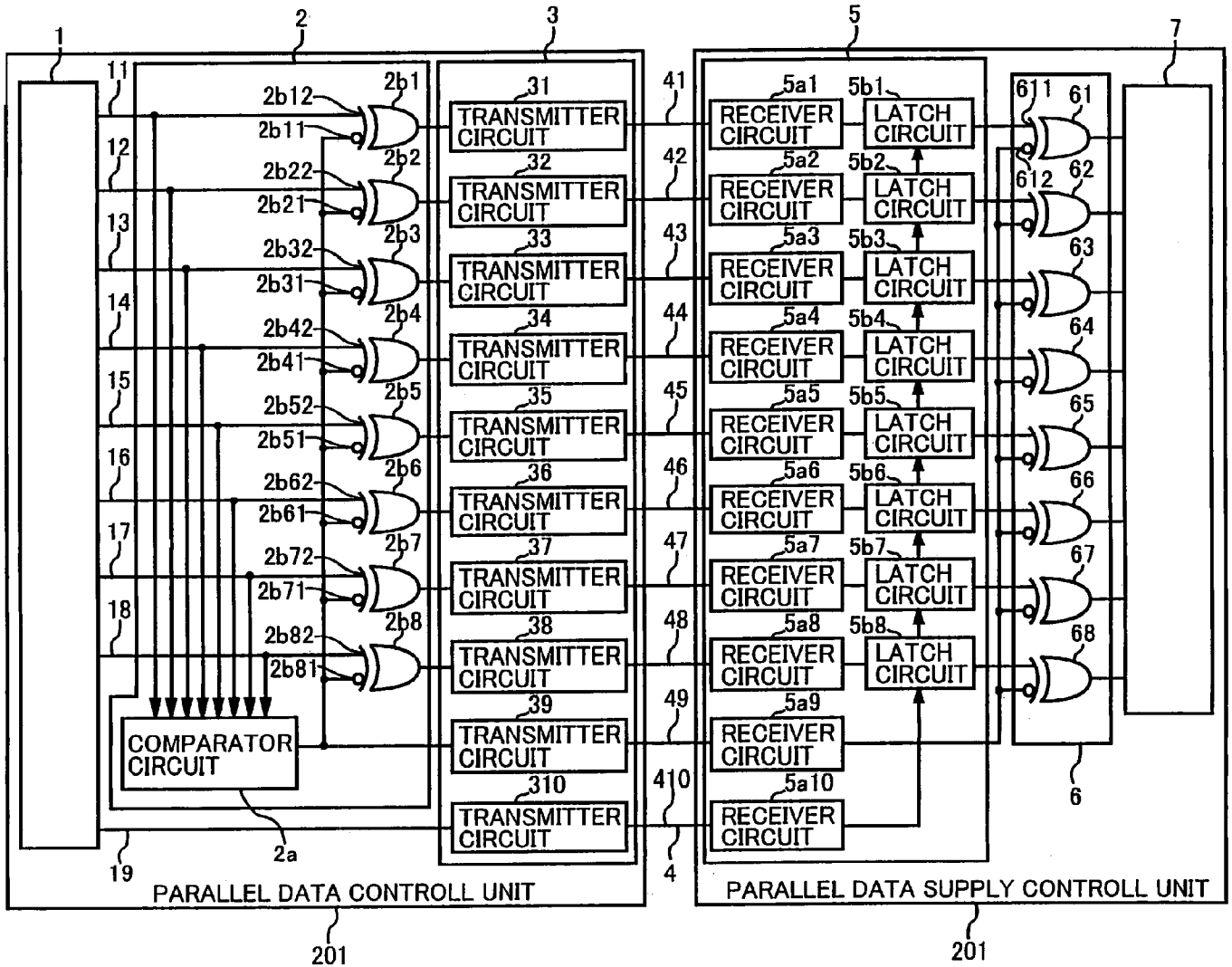
FIG. 8 is a circuit diagram showing the structure of a driver IC of the LCD panel shown in FIG. 7.

FIG. 8 is a circuit diagram showing the structure of two adjacent driver ICs 201 mounted on the LCD panel 200 shown in FIG. 7. The structure of the data transmission device in the driver IC 201 is basically the same as that of the first embodiment, and redundant explanation is omitted. Each of the driver ICs 201 has the same structure. Thus, the data receiver portions and the data transmitter portions each have the same structure. Hence, FIG. 8 simplifies the same elements. The parallel data control unit 2 may be formed only in the driver IC 201 at the uppermost stream. In this case, the inversion information outputted from the parallel data control unit 2 in the driver IC 201 at the uppermost stream is transmitted to all the driver ICs 201 at the downstream. Each driver IC 201 controls data based on this inversion information. A plurality of signal lines 41 to 410 form the transmission line 202 shown in FIG. 7. Each of the driver ICs shown in FIG. 8 is designed as a single chip.

Figure 9:
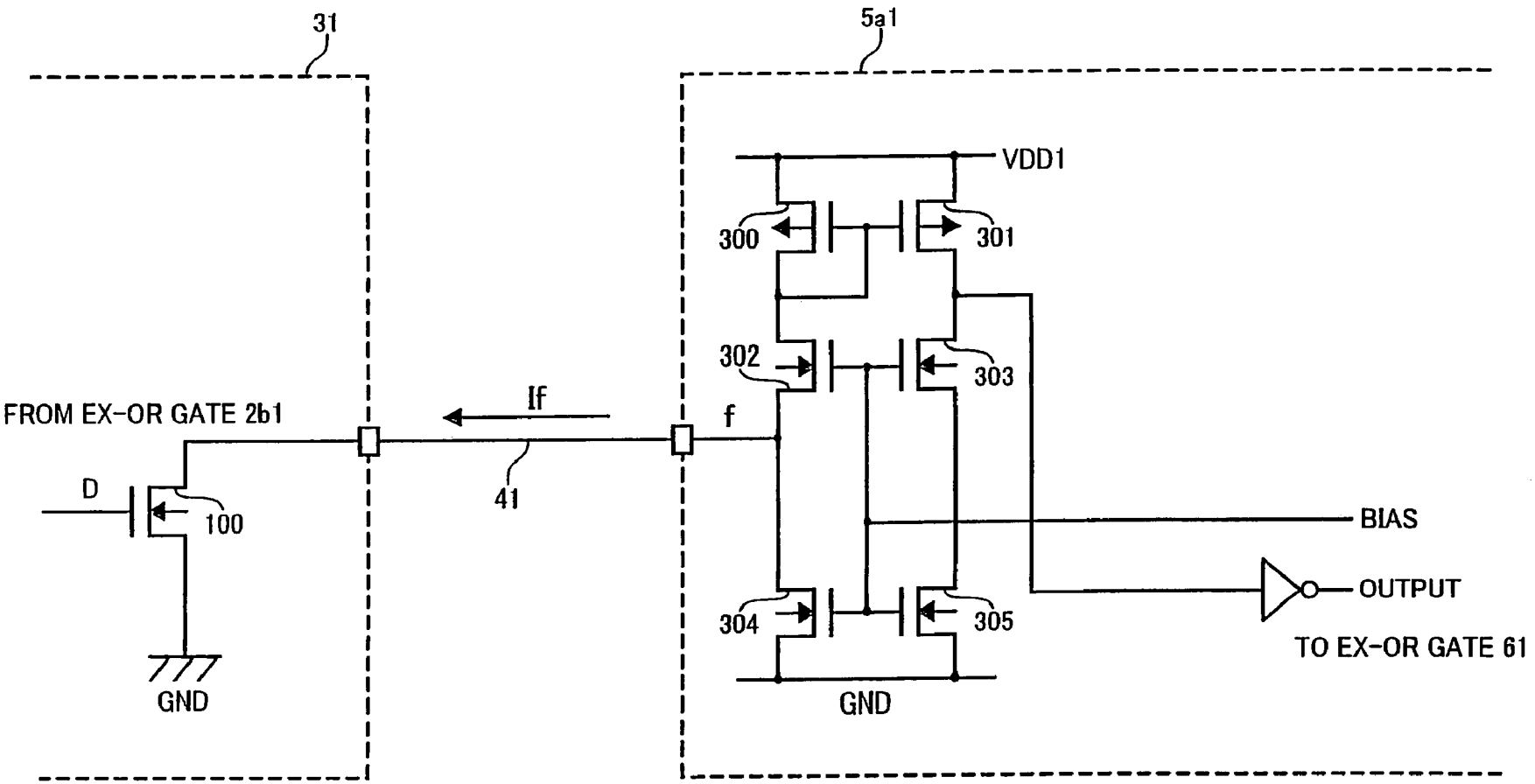
FIG. 9 is a circuit diagram showing the structure of the data transmitter portion and the data receiver portion shown in FIG. 9.

FIG. 9 is a circuit diagram showing the structures of the transmitter circuit 31 of the data transmitter portion 3 and the receiver circuit 5*a*1 of the data receiver portion 5. The transmitter circuits 32 to 310 and the receiver circuits 5*a*2 to 5*a*10 have the same structure, and the explanation is omitted. In this embodiment, the transmitter circuit 31 has an Nch open-drain transistor 100. The output of an EX-OR gate 2*b*1 is inputted to a gate of the Nch open-drain transistor 100 constituting the transmitter circuit 31. A source of the Nch open-drain transistor 100 is connected to GND, and a drain is connected to the signal line 41. Thus, when the logic level of the signal from the EX-OR gate 2*b*1 is a high level the current is drawn. Thus, the current If flows from the receiver circuit 5*a*1 to the transmitter circuit 31 through the signal line 41. On the other hand, when the logic level of the signal from the EX-OR gate 2*b*1 is a low level, the output is in the high impedance state. Thus, no current flows through the signal line 41. In FIG. 9, 300 and 301 are Pch MOS transistor and 302 to 305 are Nch MOS transistor.

We define that "L" means drawing the current on the signal line 4 and "H" means setting the signal line 4 to the high impedance state The parallel data control unit 2 inverts data or outputs data as it is based on the number of bits representing "L" in a plurality of outputs. Specifically, if the number of bits representing "L" in parallel data that is supplied to the parallel data control unit 2 is greater than the number of bits representing "H", the parallel data control unit 2 inverts each bit and outputs the inverted data. On the other hand, if the number of bits representing "L" is equal to or less than the number of bits representing "H", the parallel data control unit 2 does not invert the bits and outputs the data as it is. This allows decrease in the number of bits representing "L" in the outputted data from the parallel data control unit 2. It is thereby possible to reduce the current since the output becomes in the high impedance state with the bits representing "H". At the same time, the device outputs inversion information indicating whether the data is inverted or not. The device includes a plurality of transmitter circuits and receiver circuits shown in FIG. 9, and it outputs data in parallel.

In the case of transmitting 8-bit parallel data, the device includes a total of 10 transmitter circuits: 8 for connected to 8-bit parallel data lines, 1 (the transmitter circuit 310) for transmitting clock signals, and 1 (the transmitter circuit 39) for transmitting inversion information. Each of the transmitter circuits 31 to 310 is constituted of the Nch open-drain transistor. Similarly, the device includes a total of 10 receiver circuits.

For example, if the number of bits representing "L" is 0, (all signals on the signal lines 11 to 18 are a Low level), the comparator circuit 2*a* outputs high level. EX-OR gate receives a signal of low level as data and an inversion signal of high level from the comparator circuit 21. Therefore, EX-OR gate outputs the signal of a low level. The data from the transmitter circuit is transmitted to the receiver circuit without being inverted. Thus, Nch open-drain transistor 100 dose not turn ON, no transmission current flows through the transmission line 202. On the other hand, if the number of bits representing "L" is 8, (all signals on the signal lines 11 to 18 are a high level), the comparator circuit 2*a* outputs a low level. In this case, the transmitted data is inverted, changing all the 8-bit transmission lines 41 to 48 to "H". Thus, no transmission current flows through the transmission line 202. The receiver circuit then transforms the inverted data back into its original state by the EXOR circuits 61 to 68 and so on.

Figure 10:
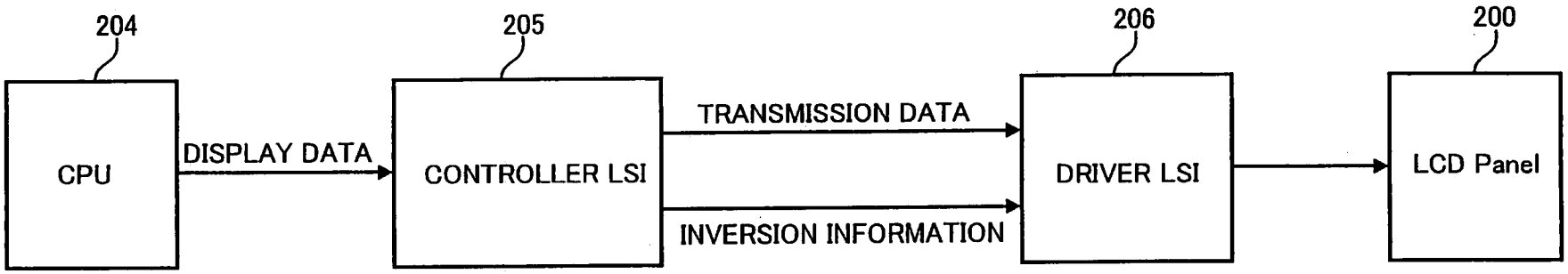
FIG. 10 is a block diagram showing the structure of a LCD panel having a different structure from the LCD panel having the driver IC shown in FIG. 8.

The data transmission device of this embodiment is also applicable to a LCD panel having the structure shown in FIG. 10. Display data from a CPU 204 is inputted to a controller LSI 205. The controller LSI 205 includes the transmitter circuit 3 and the comparator circuit 2*a* described above. The controller LSI 205 outputs transmission data together with inversion information outputted from the comparator 2*a* to a driver LSI 206, using the data transmission method explained above. The driver LSI 206 inverts the data or outputs the data as it is according to the inversion information and transmits the data to a LCD panel 201. Use of the data transmission device of this structure allows reducing a total current flowing through the signal lines.

It is apparent that the present invention is not limited to the above embodiment, that may be modified and changed without departing from the scope and spirit of the invention.

What is claimed is:

1. A data transmission device that transmits parallel data of a plurality of bits that is supplied from a transmission side in parallel to a reception side via a plurality of signal lines, each of the plurality of bits representing a first logic level or a second logic level, the data transmission device comprising:

a parallel data control unit that outputs the parallel data when the number of bits representing the first logic level in the parallel data is equal to or less than the number of bits representing the second logic level and outputs parallel data for which a logic level of each bit of the parallel data is inverted when the number of bits representing the first logic level is greater than the number of bits representing the second logic level, and outputs inversion information indicating whether the parallel data that is supplied from the transmission side is inverted;

a plurality of signal lines corresponding with each bit of the parallel data outputted by the parallel data control unit;

a data transmitter portion that allows a first current to flow to the signal lines corresponding with a bit representing the first logic level in the parallel data outputted by the parallel data control unit and allows a second current that is larger than the first current to flow to the signal lines corresponding with a bit representing the second logic level in the parallel data;

a data receiver portion that outputs parallel data of a plurality of bits by outputting a bit representing the first logic level as an output that corresponds with a signal line in which the first current flows and outputting a bit representing the second logic level as an output that corresponds with a signal line in which the second current flows; and a parallel data supply control unit that, when the inversion information indicates that parallel data supplied from the transmission side is inverted, supplies parallel data for which the logic level of each bit of the parallel data outputted by the data receiver portion is inverted to the reception side, and that, when the inversion information indicates that the parallel data supplied from the transmission side is not inverted, supplies parallel data that is outputted by the data receiver portion to the reception side.

2. The data transmission device according to claim 1, wherein the data transmitter portion renders an intensity of the first current two or more times an intensity of the second current.

3. The data transmission device according to claim 1, wherein the transmission side supplies liquid crystal display device driving data as the parallel data of a plurality of bits.

4. The data transmission device according to claim 1, wherein the data transmitter portion comprises a plurality of transmitter circuits corresponding respectively with the plurality of signal lines, each of the plurality of transmitter circuits comprising an inverter circuit that comprises a p-channel MOS transistor and an n-channel MOS transistor, in which an input terminal of the inverter circuit receives information for the bit corresponding with the signal line corresponding with the inverter circuit, and an output terminal of the inverter circuit is connected to one end of the signal line that corresponds with the inverter circuit; and the data receiver circuit comprises a plurality of receiver circuits corresponding respectively with the plurality of signal lines, each of the plurality of receiver circuits comprising: a constant current circuit one end of which is connected to the other end of the signal line that corresponds therewith and the other end of which is connected to one potential side of a power supply; a switching MOS transistor with a channel that is the same as a transistor a source of which is connected to the other potential side of the power supply in the inverter circuit that the transmitter circuit comprises, a gate and a drain of the switching MOS transistor being supplied with a potential corresponding with a potential of the other end of the signal line that corresponds with the receiver circuit and a source of which being connected to the other potential side of the power supply;

a first inversion buffer in which a potential corresponding with a potential of the other end of the signal line corresponding therewith is supplied to the input terminal thereof; and a second inversion buffer that inverts an output of the first inversion buffer.

5. The data transmission device according to claim 4, wherein each of the plurality of the transmitter circuits further comprises:

a resistance-adjusting MOS transistor that adjusts a resistance value and that is provided between a drain of a transistor, a source of which is connected to the other potential side of the power supply in the inverter circuit, and the output terminal of the inverter circuit.

6. The data transmission device according to claim 4, wherein each of the plurality of receiver circuits further comprises:

a potential adjustment portion that receives a potential adjustment signal, adjusts a potential of the other end of the signal line corresponding with the receiver circuit on the basis of the potential adjustment signal, and supplies the adjusted potential to the input terminal of the first inversion buffer and to the gate and drain of the switching MOS transistor.

7. The data transmission device according to claim 5, wherein each of the plurality of receiver circuits further comprises:

a potential adjustment portion that receives a potential adjustment signal, adjusts a potential of the other end of the signal line corresponding with the receiver circuit on the basis of the potential adjustment signal, and supplies the adjusted potential to the input terminal of the first inversion buffer and to the gate and the drain of the switching MOS transistor.

8. A data transmission method that is performed by a data transmission device that transmits parallel data of a plurality of bits that is supplied from a transmission side in parallel to a reception side via a plurality of signal lines, each of the plurality of bits representing either a first logic level or a second logic level, the data-transmission method comprising:

controlling parallel data such that, when the number of bits representing the first logic level in the parallel data is equal to or less than the number of bits representing the second logic level, the parallel data are outputted and, when the number of bits representing the first logic level is greater than the number of bits representing the second logic level, parallel data for which a logic level of each bit of the parallel data is inverted are outputted, and such that inversion information. indicating whether the parallel data that is supplied from the transmission side is inverted is outputted;

transmitting data such that a first current flows to the signal lines corresponding with a bit representing the first logic level in the parallel data that are outputted in the control of the parallel data and a second current that is larger than the first current flows to the signal lines corresponding with a bit representing the second logic level in the parallel data that are outputted in the control of the parallel data;

receiving data so that parallel data of a plurality of bits are outputted by outputting a bit representing the first logic level as an output that corresponds with a signal line in which the first current flows among the plurality of signal lines and outputting a bit representing the second logic level as an output that corresponds with a signal line in which the second current flows among the plurality of signal lines; and controlling supply of parallel data such that, when the inversion information indicates that parallel data supplied from the transmission side is inverted, parallel data for which the logic level of each bit of the parallel data outputted in the receiving data is inverted is supplied to the reception side and, when the inversion information indicates that the parallel data supplied from the transmission side is not inverted, the parallel data that is outputted in the data reception step is supplied to the receiving data.

9. The data transmission method according to claim 8, wherein, in the data transmission, an intensity of the first current is rendered two or more times an intensity of the second current.

10. The data transmission method according to claim 8, wherein the transmission side supplies liquid crystal display device driving data as the parallel data of plurality bits.

11. The data transmission method according to claim 9, wherein the transmission side supplies liquid crystal display device driving data as the parallel data of a plurality of bits.

12. A driver circuit formed on a single chip, comprising:

a plurality of data terminals receiving parallel data;

a plurality of transmitter circuits receiving the parallel data, each of the transmitter circuits controlling its output state in response to levels of the respective parallel data, one of the output state being corresponding to a current flowing state on an output line, the other one of the output state being corresponding to a high impedance state on the output line; and a data control unit receiving the parallel data and producing a control signal based on the parallel data, the control signal being respectively applied to the transmitter circuits in order to reduce current flowing through the output lines when parallel data are conveyed on the output lines.

13. A data transmission device that transmits parallel data of a plurality of bits via a plurality of signal lines, each of the plurality of bits representing a first logic level or a second logic level, the data transmission device comprising:

a parallel data control unit that outputs the parallel data when the number of bits representing the first logic level in the parallel data is equal to or less than the number of bits representing the second logic level and outputs parallel data for which a logic level of each bit of the parallel data is inverted when the number of bits representing the first logic level is greater than the number of bits representing the second logic level, and outputs inversion information indicating whether the parallel data that is supplied from a transmission side is inverted; and a data transmitter portion that allows a first current to flow to an output line corresponding with a bit representing the first logic level in the parallel data outputted by the parallel data control unit and allows a second current that is larger than the first current to flow to the output line corresponding with a bit representing the second logic level in the parallel data.

14. The data transmission device according to claim 13, wherein the data transmitter portion further comprises an Nch open-drain transistor.

* * * * *